US010115343B2

(12) United States Patent
Kang et al.

(10) Patent No.: US 10,115,343 B2
(45) Date of Patent: Oct. 30, 2018

(54) SUB-PIXEL OF ORGANIC LIGHT EMITTING DISPLAY DEVICE AND ORGANIC LIGHT EMITTING DISPLAY DEVICE INCLUDING THE SAME

(71) Applicant: LG DISPLAY CO., LTD., Seoul (KR)

(72) Inventors: DongChun Kang, Seoul (KR); JongHyun Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 15/362,325

(22) Filed: Nov. 28, 2016

(65) Prior Publication Data

US 2017/0178567 A1 Jun. 22, 2017

(30) Foreign Application Priority Data

Dec. 22, 2015 (KR) ..... 10-2015-0184114

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01); *G09G 2300/0852* (2013.01); *G09G 2300/0861* (2013.01); *G09G 2310/0248* (2013.01);
(Continued)

(58) Field of Classification Search
CPC .... G09G 3/3233; G09G 3/3241; G09G 3/325; G09G 3/3258; G09G 3/3291; G09G 2300/043; G09G 2300/0819; G09G 2300/0852; G09G 2300/0861; G09G 2310/0248; G09G 2310/0262;
(Continued)

(56) References Cited

U.S. PATENT DOCUMENTS

2006/0154422 A1* 7/2006 Chun ..... H01L 21/268 438/274
2008/0055299 A1* 3/2008 Choi ..... G09G 3/3233 345/211
(Continued)

FOREIGN PATENT DOCUMENTS

CN 1700289 A 11/2005
CN 102930819 A 2/2013
CN 104050916 A 9/2014

*Primary Examiner* — Tom Sheng
(74) *Attorney, Agent, or Firm* — Birch, Stewart, Kolasch & Birch, LLP

(57) ABSTRACT

A sub-pixel of an organic light emitting display device according to an embodiment includes an organic light emitting diode connected to a first node; a driving transistor comprising a first electrode, a second electrode connected to the first node, and a gate electrode connected to a second node; a first capacitor connected between the first node and the second node; a second capacitor connected between an emission control line and the second node; a first transistor comprising a first electrode connected to the first electrode of the driving transistor, a second electrode connected to the second node, and a gate electrode connected to a scan line; and a second transistor comprising a first electrode connected to a high potential voltage line, a second electrode connected to the first electrode of the driving transistor, and a gate electrode connected to the emission control line.

12 Claims, 8 Drawing Sheets

(52) U.S. Cl.
CPC ..... *G09G 2310/0262* (2013.01); *G09G 2320/0233* (2013.01)

(58) Field of Classification Search
CPC ..... G09G 2320/043; G09G 2320/045; G09G 2320/0233
See application file for complete search history.

(56) References Cited

U.S. PATENT DOCUMENTS

2008/0158114 A1* 7/2008 Kim ..... G09G 3/3233 345/77
2009/0051628 A1* 2/2009 Kwon ..... G09G 3/3233 345/77
2009/0135107 A1* 5/2009 Kim ..... G09G 3/3233 345/76
2009/0225013 A1* 9/2009 Lee ..... G09G 3/3233 345/80
2009/0243979 A1* 10/2009 Kim ..... G09G 3/3233 345/76
2009/0309516 A1* 12/2009 Kim ..... G09G 3/3233 315/307
2011/0148949 A1* 6/2011 Matsui ..... G09G 3/3233 345/690
2011/0164071 A1* 7/2011 Chung ..... G09G 3/3208 345/690
2011/0181192 A1* 7/2011 Ono ..... G09G 3/3233 315/169.3
2011/0227885 A1* 9/2011 Chung ..... G09G 3/3241 345/204
2011/0273428 A1* 11/2011 Han ..... G09G 3/3233 345/212
2012/0038617 A1* 2/2012 Chung ..... G09G 3/3233 345/212
2013/0106828 A1* 5/2013 Kim ..... G09G 3/3233 345/212
2014/0132175 A1* 5/2014 Hokazono ..... H01L 27/3262 315/228
2014/0176523 A1* 6/2014 Kwak ..... G09G 3/3233 345/212
2015/0029079 A1* 1/2015 Miyazawa ..... G09G 3/3233 345/82
2015/0221251 A1* 8/2015 Wang ..... G09G 3/3233 345/690
2015/0348464 A1* 12/2015 In ..... G09G 3/2022 345/205
2015/0356916 A1* 12/2015 Qian ..... G09G 3/3233 345/78
2015/0356919 A1 12/2015 Wang et al.
2015/0379929 A1* 12/2015 Zhai ..... G09G 3/3233 345/78
2016/0125803 A1* 5/2016 Qing ..... G09G 3/3233 345/209
2016/0284274 A1* 9/2016 Tan ..... G09G 3/3258
2017/0116918 A1* 4/2017 Dong ..... G09G 3/3233
2017/0178571 A1* 6/2017 Kang ..... G09G 3/3258

* cited by examiner

SUB-PIXEL OF ORGANIC LIGHT EMITTING DISPLAY DEVICE AND ORGANIC LIGHT EMITTING DISPLAY DEVICE INCLUDING THE SAME

CROSS REFERENCE TO RELATED APPLICATIONS

This application claims the priority benefit of the Korean Patent Application No. 10-2015-0184114 filed on Dec. 22, 2015, which is hereby incorporated by reference as if fully set forth herein.

BACKGROUND

Technical Field

The present disclosure relates to an organic light emitting display device and more particularly, to an organic light emitting display device with a reduced sub-pixel size, which is capable of displaying a high resolution image.

Related Technology

An organic light emitting display device, which is a self-luminous display device, does not require a separate light source in comparison to a liquid crystal display device, and is therefore made in a light weight and thin form. In addition, the organic light emitting display device is not only advantageous in terms of low power consumption due to its low voltage driving, but is also advantageous in terms of fast response speed, wide viewing angle and superior contrast ratio. For these reasons, the organic light emitting display device has been researched as a next generation display.

An organic light emitting display device includes a plurality of pixels for displaying an image. Each of the pixels includes a plurality of sub-pixels. The organic light emitting display device controls the brightness of the sub-pixel, thereby expressing various colors of the pixel, and realizing a full-color image.

The sub-pixel of the organic light emitting display device includes an organic light emitting diode (OLED) and a driving transistor providing a driving current to the organic light emitting diode. The brightness of the organic light emitting diode is determined by the amount of the driving current provided to the organic light emitting diode, and the amount of the driving current may be determined according to the electric potential difference between the gate electrode of the driving transistor and the second electrode and the threshold voltage of the driving transistor.

However, due to the characteristics of the manufacturing process, a deviation in terms of threshold voltage of the driving transistor may occur. For example, during the crystallization of the active layer of the driving transistor, the degree of the crystallization may vary with respect to each sub-pixel. In such case, the actual amount of the current provided to the organic light emitting diode may be different from the designed amount of the current. Thus, the brightness of the organic light emitting diode may be different from the desired brightness. Such deviation in terms of threshold voltage may cause irregularities of display that is referred as "Mura".

A number of compensation circuits have been developed to compensate such deviation of the threshold voltage of the driving transistor. For example, a method, which initializes each electrode of the driving transistor to a certain voltage before the emission on the organic light emitting diode, and samples the threshold voltage of the driving transistor for compensating the threshold voltage, may be used. However, to realize such a compensation method, additional transistors and lines for initializing and sampling each electrode of the driving transistor are required. To give a more specific description with respect to this compensation method, FIG. 1 is referred and discussed below.

FIG. 1 is a schematic circuit diagram illustrating the sub-pixel of a related art organic light emitting display device. Referring to FIG. 1, the sub-pixel of the related art organic light emitting display device includes an organic light emitting diode (OLED), a driving transistor $T_{dr}$, a switching transistor $T_{sw}$, a first transistor $T_1$, a second transistor $T_2$, a third transistor $T_3$, a fourth transistor $T_4$ and a first capacitor $C_1$. The sub-pixel of FIG. 1 includes six transistors and one capacitor. Thus, it may be referred to as a 6T1C structure.

In the 6T1C structure, the driving transistor $T_{dr}$ provides a driving current to the organic light emitting diode (OLED). The first capacitor $C_1$ is connected to the gate electrode of the driving transistor $T_{dr}$ for maintaining a turn-on status of the driving transistor $T_{dr}$ during an emission period. The first transistor $T_1$ is turned-on based on a first scan voltage $V_{scan1}$ supplied from a first scan line 152, and configures a diode connection of the first electrode and the gate electrode of the driving transistor $T_{dr}$. The switching transistor $T_{sw}$ is turned-on based on a second scan voltage $V_{scan2}$ supplied from a second scan line 153, and transfers the data voltage $V_{data}$ to the second electrode of the driving transistor $T_{dr}$. The second transistor $T_2$ is turned-on based on a first emission control voltage $V_{em1}$ supplied from a first emission control line 154, and connects the second electrode of the driving transistor $T_{dr}$ and the anode of the organic light emitting diode (OLED). The third transistor $T_3$ is turned-on based on the first scan voltage $V_{scan1}$, and transfers an initialization voltage $V_{ref}$ supplied from an initialization line 155 to the anode of the organic light emitting diode (OLED). The fourth transistor $T_4$ is turned-on based on a second emission voltage $V_{em2}$ supplied from a second emission control line 151, and transfers the high potential voltage $V_{dd}$ to the first electrode of the driving transistor $T_{dr}$.

That is, the sub-pixel of the 6T1C structure includes the first transistor $T_1$ and the fourth transistor $T_4$ for initializing the gate electrode and the first electrode of the driving transistor $T_{dr}$ to the high potential voltage $V_{dd}$. Further, the sub-pixel of the 6T1C structure includes the third transistor $T_3$ and the second transistor $T_2$ for initializing the second electrode of the driving transistor $T_{dr}$ and the anode of the organic light emitting diode (OLED) to the initialization voltage $V_{ref}$. Further, the sub-pixel of the 6T1C structure includes the third transistor $T_3$, the second transistor $T_2$, and the first transistor $T_1$ for sampling the threshold voltage of the driving transistor $T_{dr}$. On the other hand, the first scan line 152, the first emission control line 154 and the second emission control line 151 are additionally required to independently control each of the first to fourth transistors according to the driving timing, and the initialization line 155 is required to supply the initialization voltage $V_{ref}$.

As a result, the sub-pixel of the related art organic light emitting display device includes a driving transistor $T_{dr}$, a switching transistor $T_{sw}$, and a first capacitor $C_1$ for emitting the organic light emitting diode (OLED) and may include additional compensation transistors. Further, additional lines are additionally required for independently controlling each of the compensation transistors.

As the structure of the sub-pixel becomes more complicated, however, the size of the sub-pixel tends to be larger. Thus, the number of the sub-pixels arranged within a unit area tends to be reduced. Accordingly, this is a problem in that the resolution of the organic light emitting display device may be reduced and a manufacturing cost of the organic light emitting display device can be increased.

In addition, this is a problem in that due to the arrangement of the additional lines, a parasitic capacitance between the lines can be generated. Thus, it is a problem that an interference between the signals for driving the organic light emitting display device can occur due to a coupling by the parasitic capacitance.

Accordingly, there is a need for an improved display device in which the development of a circuit layout not only can compensate the deviation of the threshold voltage of the driving transistor but can also simplify the circuit layout and reduce the number of various lines.

SUMMARY

The inventors of the present disclosure realized that it is disadvantageous that if a compensation transistor is added to compensate the characteristics of the driving transistor, the layout of the sub-pixel becomes more complicated, and the size of the sub-pixel becomes larger. Thus, the inventors of the present disclosure disclose an organic light emitting display device including a novel layout of the sub-pixel of the organic light emitting display device with an optimized circuit layout of the sub-pixel, which is not only capable of compensating the characteristics of the driving transistor but is also capable of simplifying the layout of the sub-pixel.

Accordingly, an object of the present disclosure is to provide a small sized sub-pixel of an organic light emitting display device through a simplification of the layout and an organic light emitting display device including the sub-pixels.

Furthermore, another object of the present disclosure is to provide a simplified sub-pixel layout capable of compensating a deviation of threshold voltage of a driving transistor by modifying the layout of the sub-pixel of the organic light emitting display device and an organic light emitting display device including the sub-pixels.

It should be noted that objects of the present disclosure are not limited to the above-described objects and other objects of the present disclosure will be apparent to those skilled in the art from the following descriptions.

To solve or address the above described problems and other limitations associated with the related art, there is provided a sub-pixel of an organic light emitting display device according to an exemplary embodiment of the present disclosure. The sub-pixel includes an organic light emitting diode, a driving transistor, a first capacitor, a second capacitor, a first transistor, and a second transistor. The organic light emitting diode includes an anode connected to a first node. The driving transistor includes a first electrode of the driving transistor, a second electrode of the driving transistor connected to the first node, and a gate electrode of the driving transistor connected to a second node. The first capacitor is connected between the first node and the second node. The second capacitor is connected between an emission control line and the second node. The first transistor includes a first electrode of the first transistor connected to the first electrode of the driving transistor, a second electrode of the first transistor connected to the second node, and a gate electrode of the first transistor connected to a scan line. The second transistor includes a first electrode of the second transistor connected to a high potential voltage line, a second electrode of the second transistor connected to the first electrode of the driving transistor, and a gate electrode of the second transistor connected to the emission control line. The first capacitor and the second capacitor are configured to couple a voltage at the first node and a voltage at the second node based on an emission control voltage supplied to the emission control line. The sub-pixel of the organic light emitting display device according to an exemplary embodiment of the present disclosure has the first capacitor and the second capacitor, configured to couple a voltage at the first node and a voltage at the second node based on an emission control voltage supplied to the emission control line. Therefore, the circuit layout can be simplified and the threshold voltage of the driving transistor can be compensated. Thus, the uniformity of the brightness of the organic light emitting diode can be maintained regardless of a deviation of the threshold voltage of the driving transistor, and by reducing the size of the sub-pixel, the resolution of the organic light emitting display device can be increased.

To solve or address the above described problems and other limitations associated with the related art, there is provided an organic light emitting display device according to an exemplary embodiment of the present disclosure includes a sub-pixel, a data driver, a scan driver and an emission control driver. The data driver is configured to supply a data voltage to the sub-pixel. The scan driver is configured to supply a scan voltage to the sub-pixel. The emission control driver is configured to supply an emission control voltage to the sub-pixel. The sub-pixel includes an organic light emitting diode, a driving transistor, a first capacitor, and a second capacitor. The organic light emitting diode includes an anode connected to a first node. The driving transistor includes a first electrode of the driving transistor, a second electrode of the driving transistor connected to the first node, and a gate electrode of the driving transistor connected to a second node, which is configured to supply a driving current to the organic light emitting diode. The first capacitor is connected between the first node and the second node, which is configured to maintain an electric potential difference between the gate electrode of the driving transistor and the second electrode of the driving transistor during an emission period of the organic light emitting diode. The second capacitor is connected between the second node and an emission control line. The emission control driver is configured to supply the emission control voltage to the emission control line to couple a voltage at the first node and a voltage at the second node by the first capacitor and the second capacitor during a coupling period within the emission period.

More details of the embodiments of the present disclosure are disclosed in the detailed description and the appended drawings.

According to the present disclosure, a deviation of the threshold voltage of the driving transistor can be effectively compensated without additional compensation circuits by coupling the gate electrode of the driving transistor and the second electrode of the driving transistor by using each of the first capacitor and the second capacitor connected, to each of the gate electrode and the second electrode of the driving transistor.

Moreover, according to the present disclosure, additional transistors and lines for initializing the driving transistor and sampling the threshold voltage of the driving transistor can be omitted, thus a layout of the sub-pixel can be simplified.

It should be noted that the effects of the present disclosure are not limited to those described above and other effects of the present disclosure are included in the following descriptions.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PRESENT DISCLOSURE

Figure 1:
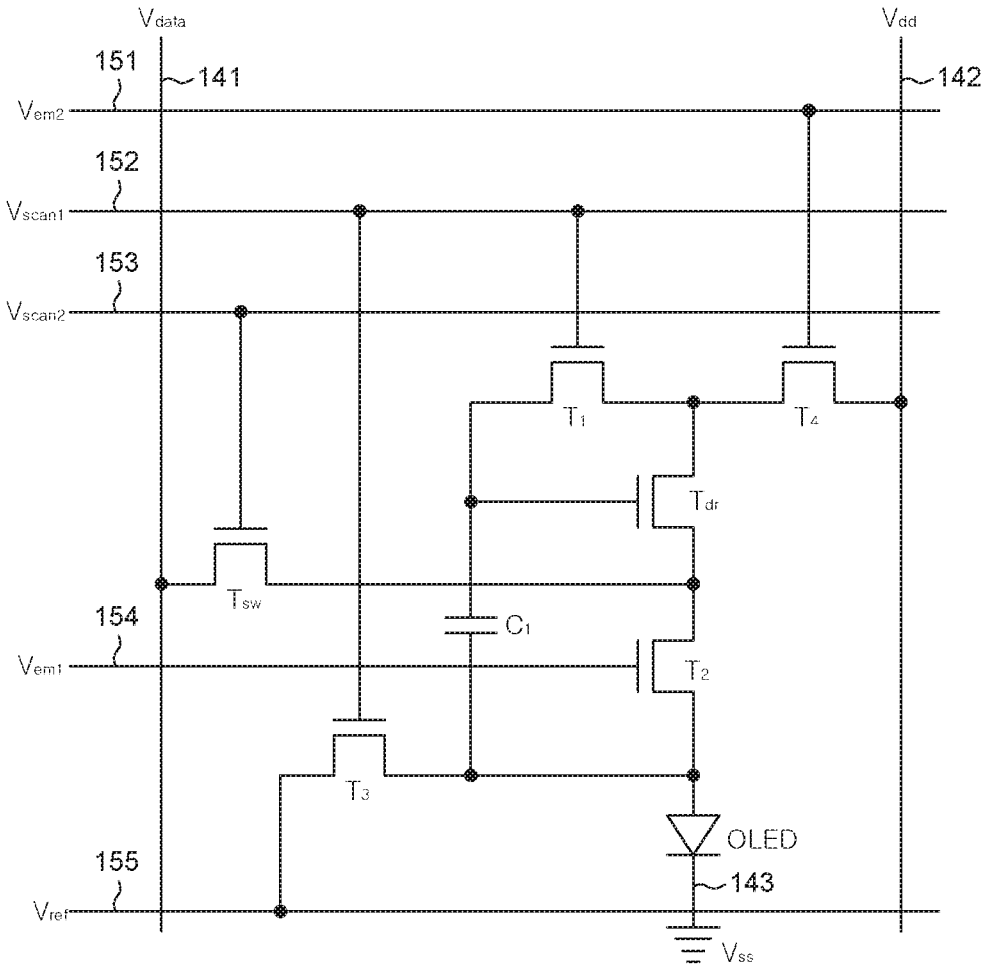
FIG. 1 (RELATED ART)
FIG. 1 is a schematic circuit diagram illustrating a sub-pixel of a related art organic light emitting display device.

Advantages and features of the present disclosure and methods for accomplishing the same will be more clearly understood from exemplary embodiments described below with reference to the accompanying drawings. However, the present disclosure is not limited to the following exemplary embodiments but may be implemented in various different forms. The exemplary embodiments are provided only to complete disclosure of the present disclosure and to fully provide a person having ordinary skill in the art to which the present disclosure pertains with the category of the invention and the present invention will be defined by the appended claims.

The shapes, sizes, ratios, angles, numbers and the like illustrated in the accompanying drawings for describing the exemplary embodiments of the present disclosure are merely examples and the present disclosure is not limited thereto. Like reference numerals generally denote like elements throughout the present specification. Further, in the following description, a detailed explanation of known related technologies may be omitted to avoid unnecessarily obscuring the subject matter of the present disclosure. The terms such as "including", "having", "comprising" and "consist of" used herein are generally intended to allow other components to be added unless the terms are used with the term "only". Any references to singular may include plural unless expressly stated otherwise.

Components are interpreted to include an ordinary error range or an ordinary tolerance range even if not expressly stated.

When the position relation between two parts is described using the terms such as "on", "above", "below" and "next", on or more parts may be positioned between the two parts unless the terms are used with the term "immediately" or "directly".

When an element or layer is referred to as being "on" another element or layer, it may be directly on the other element or layer, or intervening elements or layers may be present.

Although the terms "first", "second" and the like are used for describing various components, these components are not confined by these terms. These terms are merely used for distinguishing one component from the other components. Therefore, a first component to be mentioned below may be a second component in a technical concept of the present disclosure.

Throughout the whole specification, the same reference numerals denote the same or similar elements.

Since the size and thickness of each component illustrated in the drawings are represented for convenience in explanation, the present disclosure is not necessarily limited to the illustrated size and thickness of each component.

The features of various embodiments of the present disclosure can be partially or entirely bonded to or combined with each other and can be interlocked and operated in technically various ways as can be fully understood by a person having ordinary skill in the art and the embodiments can be carried out independently of or in association with each other.

Various exemplary embodiments of the present disclosure will be described in detail with reference to the accompanying drawings.

Figure 2:
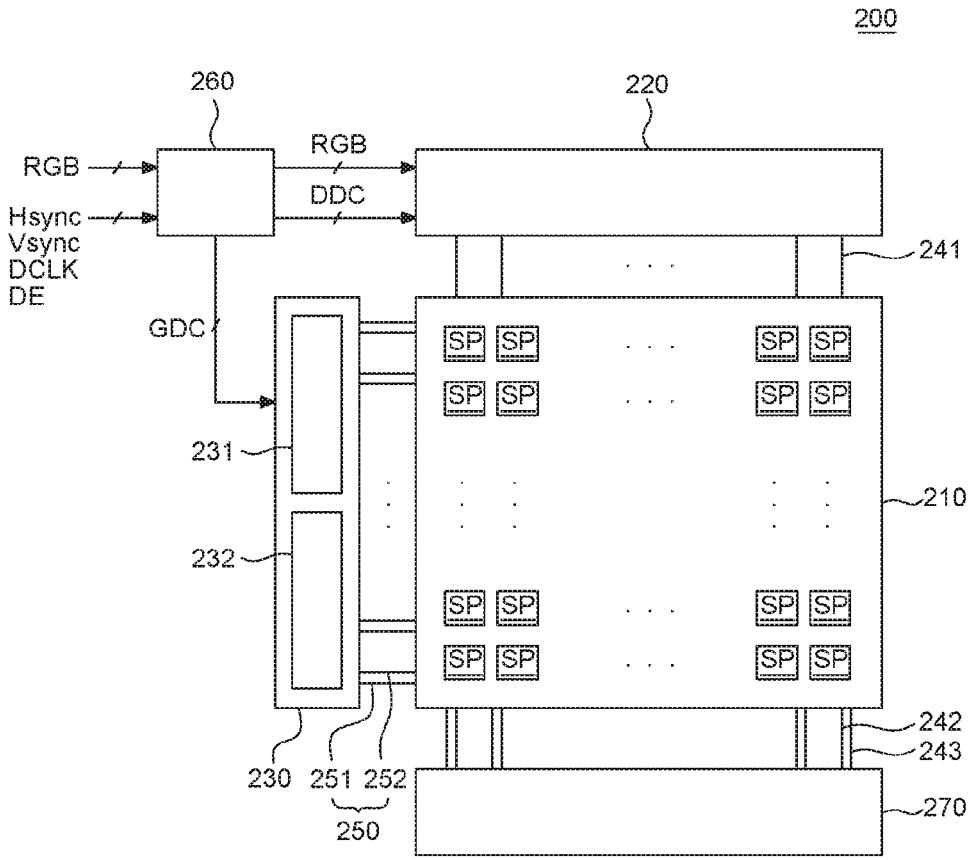
FIG. 2 is a schematic block diagram illustrating an organic light emitting display device according to an exemplary embodiment of the present disclosure.

FIG. 2 is a schematic block diagram illustrating an organic light emitting display device according to an exemplary embodiment. All the components of the organic light emitting display device according to all embodiments of the present disclosure are operatively coupled and configured.

Referring to FIG. 2, the organic light emitting display device 200 according to the exemplary embodiment of the present disclosure includes a display panel 210, a timing controller 260, a data driver 220, a gate driver 230 and a power supply unit 270.

The display panel 210 includes a plurality of sub-pixels SP and displays an image by emitting an organic light emitting diode of the sub-pixel SP. The sub-pixel SP is defined by crossing of a data line 241 and a gate line 250, is configured to receive driving signals from the data line 241 and a scan line 251 and arranged in a form of matrix in the display panel 210. The sub-pixel SP may emit at least one color among red, green, blue and white. For example, the sub-pixel SP may be a red sub-pixel SP emitting red light, a green sub-pixel SP emitting green light and a blue sub-pixel SP emitting blue light. The red, green, and blue sub-pixel SP may function as a pixel.

The sub-pixel SP includes at least one transistor connected to an organic light emitting diode and a capacitor. The layout of the sub-pixel SP will be described with reference to FIG. 3.

The timing controller 260 is an element to control a driving timing of a data driver 220 and a gate driver 230. The timing controller 260 rearranges the digital video data RGB received from an external system with respect to the resolution of the display panel 210 and then supply to the data driver 220. Further, the timing controller 260 generates a data control signal DDC to control a timing of the data driver 220, and a gate control signal GDC to control a timing of the gate driver 230 based on timing signals such as a vertical synchronization signal Vsync, a horizontal synchronization signal Hsync, a dot clock signal DCLK, a data enables signal DE and the like.

The data driver 220 is an element for supplying a data voltage to a data line 241. The data driver 220 converts the digital video data RGB, received from the timing controller 260 based on the data control signal DDC, into an analogue type data voltage, then supply to a data line 241.

Further, the data driver 220 supplies an initialization voltage to a data line 241. The organic light emitting diode can be initialized based on the initialization voltage supplied from the data driver 220. The initialization process of the organic light emitting diode will be described with reference to FIG. 3 to FIG. 5D.

The data driver 220 may be applied to a display device with a chip-on-glass (COG) technology, a tape-carrier-package (TCP) and a chip-on-film (COF) technology.

The gate driver 230 is an element to drive the gate line 250. The gate driver 230 generates a scan voltage, an emission control voltage and a programming voltage based on the gate control signal GDC. To be specific, the gate driver 230 includes a scan driver 231 configured to supply a scan voltage to a scan line 251, and an emission control driver 232 configured to supply an emission control voltage to an emission control line 252.

In some embodiments, the scan driver 231 and the emission control driver 232 may be configured as an integrated circuit IC. In such case, the gate driver 230 may supply a scan voltage to a scan line 251 in a sequential manner and may supply an emission control voltage to an emission control line 252 in a sequential manner. The gate driver 230 may be applied as a gate in panel (GIP) type on the substrate of the display panel 210, but the present disclosure is not limited thereto and the gate driver 230 may be mounted on an additional circuit board then connected to the display panel 210.

The power supply unit 270 is an element to supply a high potential voltage to a high potential voltage line 242 and supply a low potential voltage to a low potential voltage line 243. The power supply unit 270 may be configured of a DC-DC converter generating a high potential voltage and a low potential voltage by boosting or inverting the input voltage from a battery or a power generating unit.

The sub-pixel SP is driven based on the supplied voltages from the gate driver 230 and the data driver 220, and the layout may be simplified. To give more detailed description with respect to the layout of the sub-pixel, FIG. 3 is referred.

Figure 3:
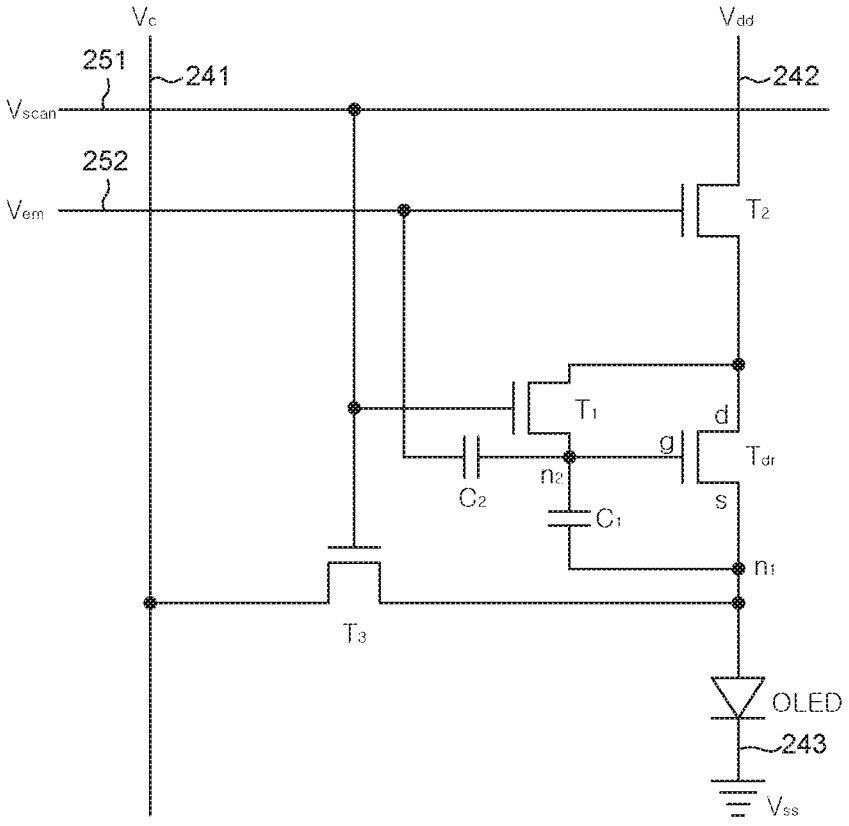
FIG. 3 is a schematic circuit diagram illustrating a sub-pixel of an organic light emitting display device according to an exemplary embodiment of the present disclosure.

FIG. 3 is a schematic circuit diagram illustrating a sub-pixel of an organic light emitting display device according to an exemplary embodiment. Referring to FIG. 3, the sub-pixel includes an organic light emitting diode (OLED), a driving transistor $T_{dr}$, a first transistor $T_1$, a second transistor $T_2$, a third transistor $T_3$, a first capacitor $C_1$ and a second capacitor $C_2$. According to an exemplary embodiment of the present disclosure, every transistor of the sub-pixel is configured of NMOS transistor. But the present disclosure is not limited thereto, and the transistors of the sub-pixel may be realized of a PMOS transistor, a NMOS transistor and/or a CMOS structure comprising both of the PMOS and NMOS transistors. In FIG. 2, a sub-pixel configured of a NMOS transistor is illustrated. From now on, a sub-pixel configured of a NMOS transistor will be regarded as a reference for further description.

The organic light emitting diode (OLED) includes an anode connected to a first node $n_1$ and a cathode connected to the low potential voltage line 243. The organic light emitting diode (OLED) includes an organic emission layer, which is emitted based on a hole provided from the anode and an electron provided from the cathode, and the organic emission layer emit at least one light among red light, green light, blue light and white light.

The driving transistor $T_{dr}$ includes a first electrode d, a second electrode s and a gate electrode g. If the driving transistor $T_{dr}$ is configured of a NMOS transistor, the first electrode d corresponds to a drain electrode and the second electrode s corresponds to a source electrode. However, if the driving transistor $T_{dr}$ is configured of a PMOS transistor, the first electrode d may correspond to a source electrode and the second electrode s may correspond to a drain electrode. The first electrode d of the driving transistor $T_{dr}$ is connected to the second electrode of the first transistor $T_1$, and the second electrode s of the driving transistor $T_{dr}$ is connected to the first node $n_1$, and the gate electrode g of the driving transistor $T_{dr}$ is connected to the second node $n_2$.

The first transistor $T_1$ includes a first electrode connected to the first electrode d of the driving transistor $T_{dr}$, a second electrode connected to the second node $n_2$, and a gate electrode connected to the scan line 251. The first transistor $T_1$ configures a diode connection with respect to the driving transistor $T_{dr}$.

The second transistor $T_2$ includes a first electrode connected to the high potential voltage line 242, a second electrode connected to the first electrode d of the driving transistor $T_{dr}$, and a gate electrode connected to the emission control line 252.

The third transistor $T_3$ includes a first electrode connected to the data line 241, a second electrode connected to the first node $n_1$, and a gate electrode connected to the scan line 251.

The first capacitor $C_1$ is connected to the second node $n_2$ and the first node $n_1$. The second capacitor $C_2$ is connected to the emission control line 252 and the second node $n_2$. That is, the first capacitor $C_1$ and the second capacitor $C_2$ are mutually connected to each other by the second node $n_2$.

As illustrated in FIG. 3, the elements configuring the sub-pixel are operatively connected and emit the organic light emitting diode at certain brightness during an emission period. From now on, a detailed operation process will be described with reference FIG. 4 to FIG. 5D.

Figure 4:
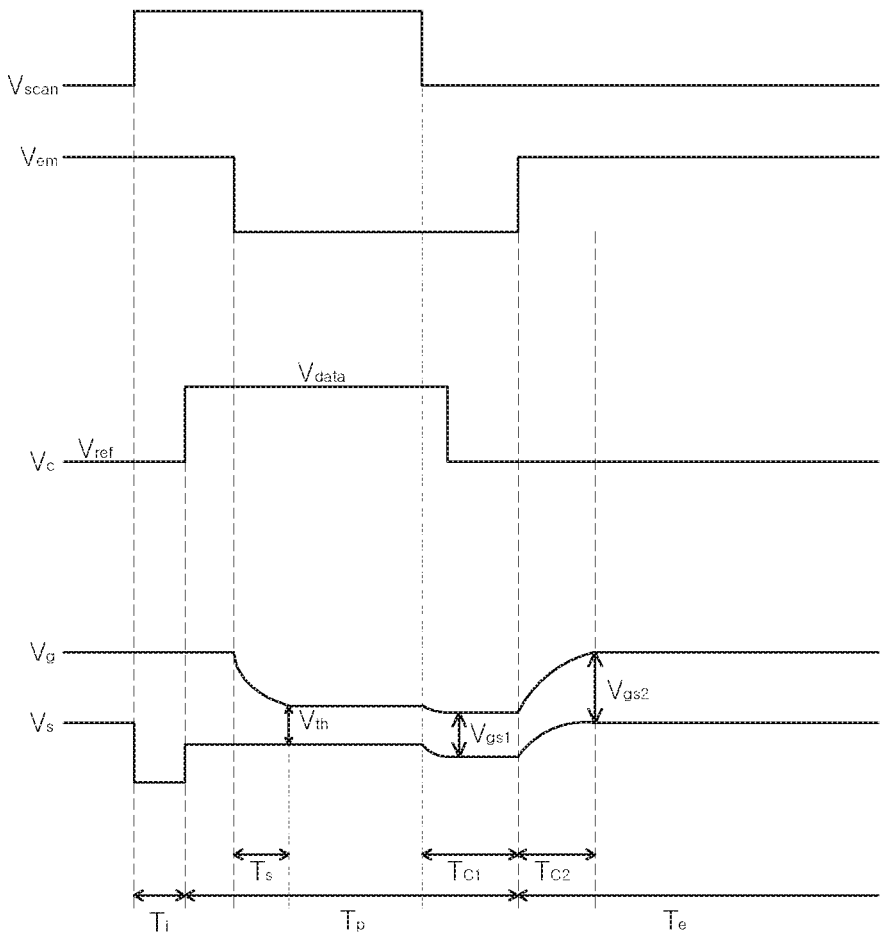
FIG. 4 is a schematic timing graph for illustrating an operation of the sub-pixel as illustrated in FIG. 3.

FIG. 4 is a schematic timing graph for illustrating an operation of a sub-pixel as illustrated in FIG. 3. FIG. 5A to 5D are schematic circuit diagrams for illustrating an operation of a sub-pixel. FIG. 4 illustrates the respective waveforms of voltages applied to the scan line 251, the emission control line 252 and the data line 241 of the respective sections of the operation of the sub-pixel. In FIG. 4, $V_g$ and $V_s$ waveforms correspond to change in the voltage level of the gate electrode g and the second electrode s of the driving transistor $T_{dr}$, respectively. FIG. 4 is a timing diagram for describing an operation of the sub-pixel of $n^{th}$ frame (where n is a positive integer), and the $n^{th}$ frame may be defined as a time period from the start of the initialization period $T_i$ to the end of the emission period $T_e$.

Figure 5A:
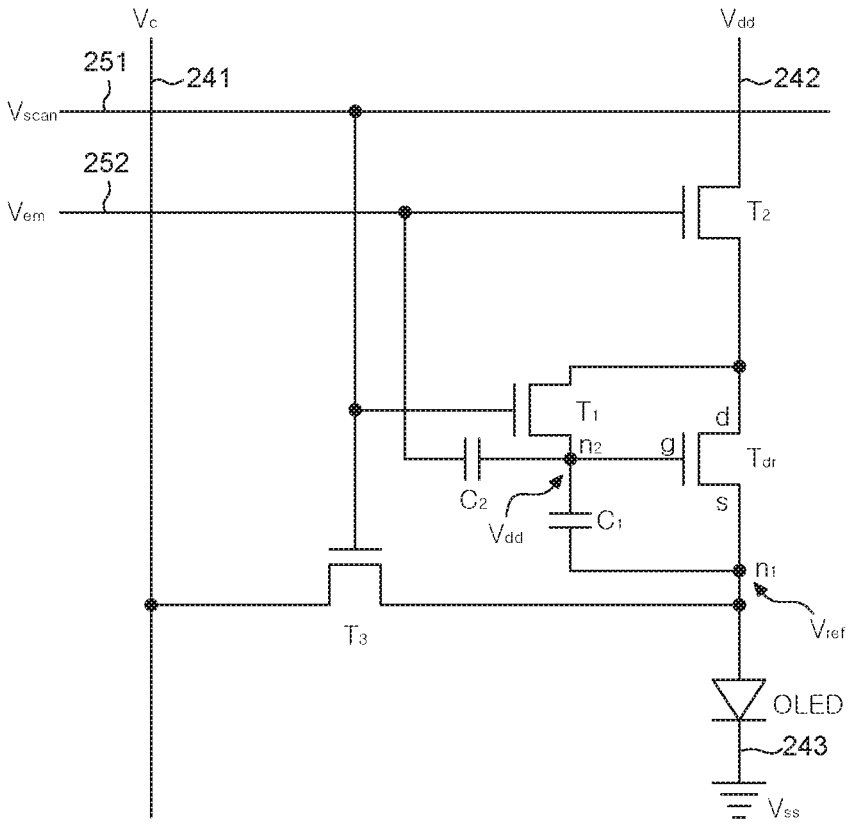
FIG. 5A to 5D are schematic circuit diagrams for illustrating an operation of a sub-pixel according to an embodiment of the present disclosure.

Referring to FIG. 4 and FIG. 5A, when a scan voltage $V_{scan}$ is applied to the scan line 251, the n-1$^{th}$ frame ends then the initialization period $T_i$ of the $n^{th}$ frame starts. The first transistor $T_1$ and the third transistor $T_3$ are turned-on according to the applied scan voltage $V_{scan}$ in the initialization period $T_i$. The turned-on first transistor $T_1$ based on the scan voltage $V_{scan}$ connects the first electrode d of the driving transistor $T_{dr}$ and the second node $n_2$. Further, the turned-on third transistor $T_3$ based on the scan voltage $V_{scan}$ connects the first node $n_1$ and the data line 241.

The emission control voltage $V_{em}$ is applied to the emission control line 252 during the initialization period $T_i$. That is, the emission control driver of the gate driver is configured to apply the emission control voltage $V_{em}$ to the emission control line 252 from the emission period of the n-1$^{th}$ frame to the initialization period of the $n^{th}$ frame.

The second transistor $T_2$ is turned-on based on the emission control voltage $V_{em}$ and transfer the high potential voltage $V_{dd}$ to the first electrode d of the driving transistor $T_{dr}$ at the initialization period $T_i$. As the first transistor $T_1$ is turned-on based on the scan voltage $V_{scan}$ during the initialization period $T_i$, the high potential voltage $V_{dd}$ transferred from the second transistor $T_2$ is applied to the second node $n_2$. Accordingly, the second node $n_2$ is initialized to the high potential voltage $V_{dd}$.

On the other hand, the data driver applies the initialization voltage $V_{ref}$ to the data line 241 during the initialization period $T_i$. In such case, the third transistor $T_3$ is under the turned-on status based on the scan voltage $V_{scan}$, the initialization voltage $V_{ref}$ is applied to the first node $n_1$ through the third transistor $T_3$. Accordingly, the first node $n_1$ is initialized to the initialization voltage $V_{ref}$. In such case, the voltage level of the initialization voltage $V_{ref}$ is the same or the less voltage level of the low potential voltage $V_{ss}$. Thus, no current flows to the organic light emitting diode (OLED) during the initialization period $T_i$ and the organic light emitting diode does not emit light.

As a result, the third transistor $T_3$ functions as an initialization transistor for initializing the anode of the organic light emitting diode (OLED) and the second electrode s of the driving transistor $T_{dr}$, during the initialization period $T_i$. Further, the second transistor $T_2$ and the first transistor $T_1$ function as initialization transistors for initializing the first electrode d and the gate electrode g of the driving transistor $T_{dr}$, during the initialization period $T_i$.

Figure 5B:
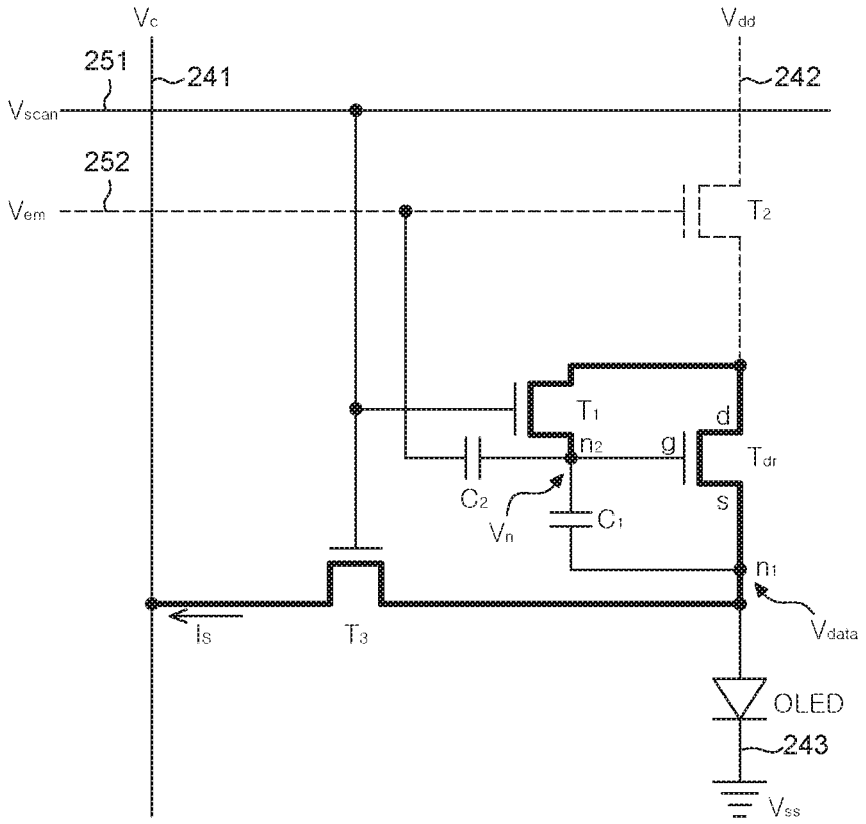

Referring to FIG. 4 and FIG. 5B, the data driver applies a data voltage $V_{data}$ to the data line 241 during the programming period $T_p$, after the initialization period $T_i$. That is, the data driver is configured to apply an initialization voltage $V_{ref}$ to the data line 241 during the initialization period $T_i$, and apply a data voltage $V_{data}$ to the data line 241 during at least portion of the programming period $T_p$. Accordingly, the initialization voltage $V_{ref}$ and the data voltage $V_{data}$ are complexly applied to the data line 241 according to the driving timing.

Only a data voltage $V_{data}$ is applied to a data line of a sub-pixel of a related art organic light emitting display device, and an initialization voltage $V_{ref}$ is applied through an additional initialization line. However, the data driver, according to an exemplary embodiment of the present disclosure, is configured to apply an initialization voltage $V_{ref}$ to the data line 241 during the initialization period $T_i$, and a data voltage $V_{data}$ to the data line 241 during at least a portion of the programming period $T_p$. Accordingly, an initialization voltage line for transferring an initialization voltage $V_{ref}$ can be omitted. The voltage applied to the data line 241 may be referred as a complex voltage $V_c$ as the data voltage $V_{data}$ and the initialization voltage $V_{ref}$ are complexly applied to the data line 241. In such case, the high level voltage of the complex voltage $V_c$ corresponds to the data voltage $V_{data}$, and the low level voltage of the complex voltage $V_c$ corresponds to the initialization voltage $V_{ref}$.

The data voltage $V_{data}$ transferred from the data driver has a voltage level determining the gray level of the organic light emitting diode (OLED). That is, the data driver applies a data voltage $V_{data}$ corresponds to a specific gray level to the data line 241, and the organic light emitting diode (OLED) emits with respect to the data voltage $V_{data}$ corresponding to the gray level at the emission period $T_e$.

The third transistor $T_3$ maintains the turned-on status as the scan voltage $V_{scan}$ is constantly applied to the scan line 251 during at least a portion of the programming period $T_p$. Accordingly, the applied data voltage $V_{data}$ is transferred to the first node $n_1$.

On the other hand, the second transistor $T_2$ is turned-off during at least a portion of the programming period $T_p$ after the data voltage $V_{data}$ is applied to the first node $n_1$. That is, the emission control driver applies an emission control voltage $V_{em}$ of a low level to the emission control line 252. The sampling period $T_s$ starts after the second transistor $T_2$ is turned-off based on the emission control voltage $V_{em}$ of the low level.

If the second transistor $T_2$ is turned-off, a current path is configured from the second node $n_2$ to the first node $n_1$. To be specific, a high potential voltage $V_{dd}$ is charged at the second node $n_2$ during the initialization period $T_i$. In such case, the electric potential difference between the high potential voltage $V_{dd}$ and the data voltage $V_{data}$ can be set to be higher than the threshold voltage of the driving transistor $T_{dr}$. Accordingly, the electric potential difference between the gate electrode g and the second electrode s of the driving transistor $T_{dr}$ is higher than the threshold voltage $V_{th}$ of the driving transistor $T_{dr}$. Thus, the driving transistor $T_{dr}$ is turned-on.

On the other hand, the first transistor $T_1$ maintains the turn-on status. Consequently, the second node $n_2$ is connected to the first node $n_1$ by the first transistor $T_1$ and the driving transistor $T_{dr}$. Accordingly, a sampling current $I_s$ flows from the second node $n_2$ to the first node $n_1$, and the sampling current $I_s$ is discharged to the data line 241 by the third transistor $T_3$. In such case, the sampling current $I_s$ is discharged from the second node $n_2$ to the first node $n_1$, and then to the third transistor $T_3$ until the voltage level difference between the voltage $V_n$ of the second node $n_2$ and the data voltage $V_{data}$ applied to the first node $n_1$ becomes the same as the threshold voltage $V_{th}$ of the driving transistor $T_{dr}$. If the electric potential difference between the voltage $V_n$ of the second node $n_2$ and the data voltage $V_{data}$ applied to the first node $n_1$ and the threshold voltage $V_{th}$ of the driving transistor $T_{dr}$ become the same, then the driving transistor $T_{dr}$ is turned-off. Thus, the sampling period $T_s$ terminates.

As a result, the first transistor $T_1$ and the third transistor $T_3$ operate as sampling transistors for sampling the threshold voltage $V_{th}$ of the driving transistor $T_{dr}$ during the sampling period $T_s$.

After the sampling period $T_s$, the first transistor $T_1$ and the third transistor $T_3$ maintain the turn-on status for a certain period. Thus, the data voltage $V_{data}$ is continuously applied to the first node $n_1$. When the electric potential difference between the gate electrode g and the second electrode s of the driving transistor $T_{dr}$ is equal to the threshold voltage $V_{th}$ of the driving transistor $T_{dr}$, the driving transistor $T_{dr}$ is turned-off. Consequently, the voltage of the second node $n_2$ has a voltage value corresponding to the sum of the data voltage $V_{data}$ and the threshold voltage $V_{th}$ of the driving transistor $T_{dr}$, and the threshold voltage $V_{th}$ of the driving transistor $T_{dr}$ is charged in the first capacitor $C_1$.

Figure 5C:
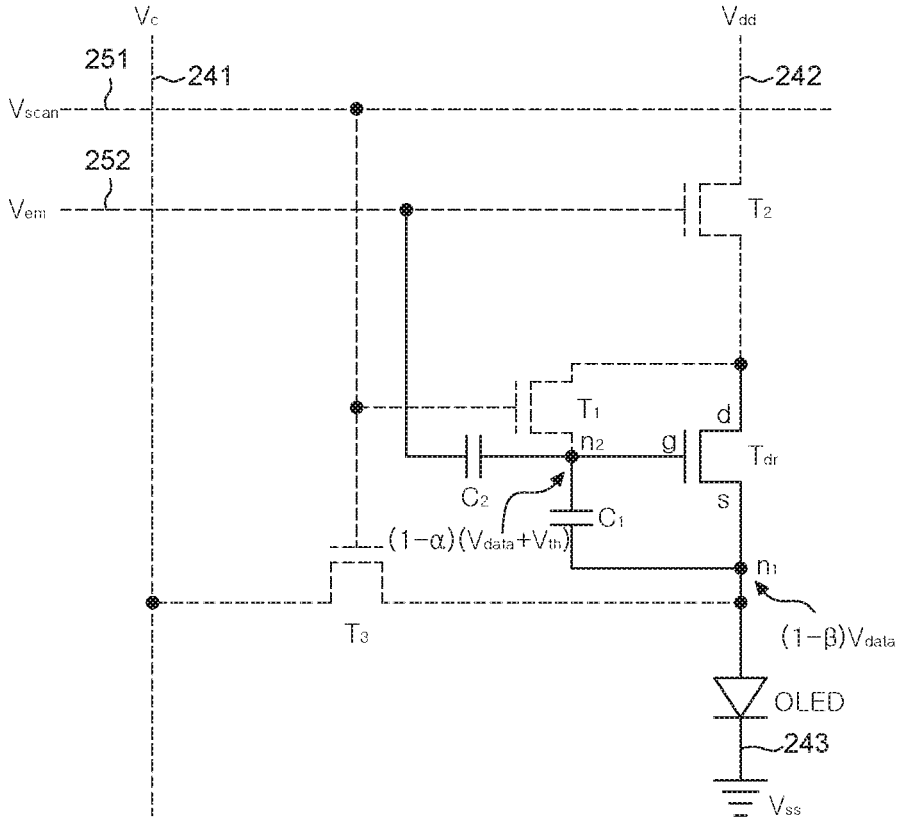

Referring to FIG. 4 and FIG. 5C, the first transistor $T_1$ and the third transistor $T_3$ are turned-off at the first coupling period $T_{c1}$ by the scan voltage $V_{scan}$ of the low level applied to the scan line 251. Accordingly, the first node $n_1$ and the second node $n_2$ are electrically floating. In such case, the scan voltage $V_{scan}$ applied to the gate electrode of the first transistor $T_1$ is changed. Thus, the voltages at the first node $n_1$ and the second node $n_2$ are coupled with the first capacitor $C_1$, the second capacitor $C_2$, and the first transistor $T_1$, thereby slightly changing said voltages. To be specific, the voltage at the second node $n_2$ is changed by coupling with the first capacitor $C_1$ and the second capacitor $C_2$ which are connected to the second node $n_2$. Further, the voltage of the second node $n_2$ can be changed due to coupling by a capacitance between the gate electrode and the second electrode of the first transistor $T_1$ connected to the second node $n_2$. In such case, the first capacitor $C_1$, the second capacitor $C_2$, and the capacitance of the first transistor $T_1$ are connected in parallel with respect to the second node $n_2$. Thus, due to the voltage distribution phenomenon of the capacitor, the voltage $V_{n2}$ of the second node $n_2$ is changed as [Equation 1] below.

$$V_{n2} = V_{data} + V_{th} - \left(\frac{C_{gs}}{C_2 + C_1 + C_{gs}} V_{scan}\right)(V_{data} + V_{th}) = (1-\alpha)(V_{data} - V_{th}) \quad \text{[Equation 1]}$$

wherein $V_{n2}$ is the voltage of the second node $n_2$, $C_{gs}$ is the capacitance between the gate electrode and the second electrode of the first transistor $T_1$, $C_1$ is the capacitance of the first capacitor $C_1$, $C_2$ is the capacitance of the second capacitor $C_2$, $\alpha$ is a value defined as $C_{gs}V_{scan}/(C_2+C_1+C_{gs})$.

On the other hand, the voltage of the first node $n_1$ may be changed by coupling with the first capacitor $C_1$ connected to the first node $n_1$, the second capacitor $C_2$, and the capacitance between the gate electrode and the second electrode of the first transistor $T_1$. In such case, the first capacitor $C_1$ and the second capacitor $C_2$ are connected in series based on the first node $n_1$ as a fiducial point, and the capacitance of the first transistor $T_1$ is connected in parallel based on the first node $n_1$ as a fiducial point, consequently, due to the voltage distribution principle of the capacitor, the voltage $V_{n1}$ of the first node $n_1$ is changed as [Equation 2]below.

$$V_{n1} = V_{data} - \left(\frac{C_{gs}}{\frac{1}{\frac{1}{C_2} + \frac{1}{C_1}} + C_{gs}} V_{scan}\right)(V_{data}) = (1-\beta)V_{data} \quad \text{[Equation 2]}$$

wherein $V_{n1}$ is the voltage of the first node $n_1$, and $\beta$ is a value defined as $$\frac{C_{gs}}{\frac{1}{\frac{1}{C_2} + \frac{1}{C_1}} + C_{gs}} V_{scan}.$$

As a result, the first transistor $T_1$ and the second transistor $T_2$ are turned-off in the first coupling period $T_{c1}$. Accordingly, the first node $n_1$ and the second node $n_2$ are electrically on a floating status, and the voltage $V_{n1}$ of the first node $n_1$ and the voltage $V_{n2}$ of the second node $n_2$ are changed by coupling with the second capacitor $C_2$, the first capacitor $C_1$ and the capacitance between the gate electrode and the second electrode of the first transistor $T_1$.

Figure 5D:
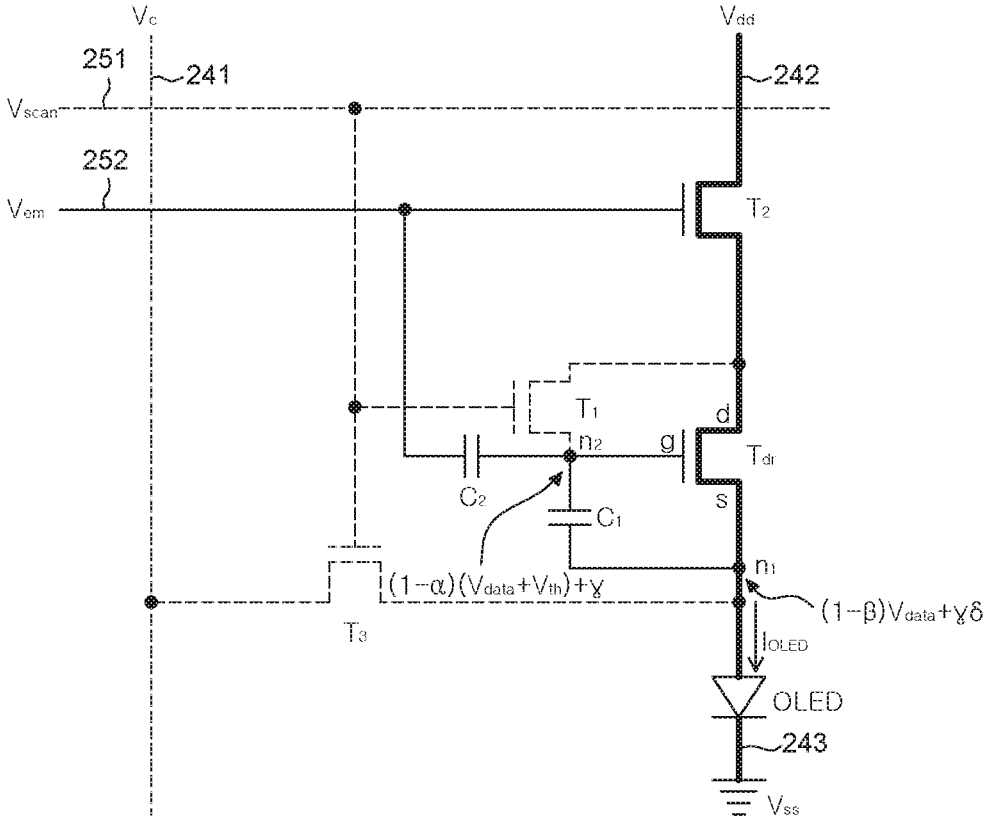

Referring to FIG. 4 and FIG. 5D, an emission control voltage $V_{em}$ is applied to the emission control line 252 in the emission period $T_e$. The second transistor $T_2$ turns-on based on the emission control voltage $V_{em}$, and the high potential voltage $V_{dd}$ is applied to the first electrode d of the driving transistor $T_{dr}$ through the second transistor $T_2$. In the first coupling period $T_{c1}$, a voltage value determined by [Equation 1] is applied to the gate electrode g of the driving transistor $T_{dr}$. Accordingly, a voltage higher than the threshold voltage $V_{th}$ of the driving transistor $T_{dr}$ is applied to the gate electrode g of the driving transistor $T_{dr}$. Therefore, the driving transistor $T_{dr}$ has a turn-on status, and the high potential voltage $V_{dd}$ is applied to the anode of the organic light emitting diode (OLED).

However, even if the high potential voltage $V_{dd}$ is applied to the anode of the organic light emitting diode (OLED), the organic light emitting diode (OLED) does not emit unless the electric potential difference between the anode and cathode of the organic light emitting diode (OLED) is above a certain level due to the characteristic of the organic light emitting diode (OLED). Accordingly, the second node $n_2$ and the first node $n_1$ can still maintain the electrically floating status during a short period for securing the electric potential difference between the anode and the cathode of the organic light emitting diode (OLED). On the other hand, a change in voltage may occur to one electrode of the second capacitor $C_2$ as the emission control voltage $V_{em}$ is applied to the emission control line 252. In this case, the voltage of the first node $n_1$ and the voltage of the second node $n_2$, which are electrically floating, is changed once again by coupling with the first capacitor $C_1$ and the second capacitor $C_2$ during the short period just before the emission of the organic light emitting diode (OLED). For the sake of the brevity for convenience of description, the period just before the emission of the organic light emitting diode (OLED) is defined as a second coupling period $T_{c2}$.

To be specific, the voltage of the second node $n_2$ is changed by coupling with the first capacitor $C_1$ connected to the second node $n_2$ and the second capacitor $C_2$. Furthermore, the voltage of the second node $n_2$ may be changed by coupling with a parasitic capacitance of the lines adjacent to the second node.

In this case, the first capacitor $C_1$, the second capacitor $C_2$, and the parasitic capacitance are connected in parallel based on the second node $n_2$ as a fiducial point. Thus, due to the voltage distribution phenomenon of the capacitor, the voltage $V_{n2}$ of the second node $n_2$ is changed as [Equation 3]below.

$$V_{n2} = (1-\alpha)(V_{data} + V_{th}) + \left(\frac{C_2}{C_2 + C_1 + C_{p2}}\right)V_{em} = (1-\alpha)(V_{data} + V_{th}) + \gamma \quad \text{[Equation 3]}$$

wherein $C_{p2}$ is the parasitic capacitance generated by the second node $n_2$ and the adjacent lines, and $\gamma$ is a value determined by $V_{em}C_2/(C_2+C_1+C_{p2})$.

Moreover, by applying the same principle, the voltage $V_{n1}$ of the first node $n_1$ may be changed by coupling with the first capacitor $C_1$ connected to the first node $n_1$ and the parasitic capacitance of the adjacent lines around the first node $n_1$. In this case, the first capacitor $C_1$ and the parasitic capacitance are connected in parallel based on the first node $n_1$ as a fiducial point. Thus, due to the voltage distribution phenomenon of the capacitor, the voltage $V_{n1}$ of the first node $n_1$ is changed as [Equation 4] below.

$$V_{n1} = (1-\beta)(V_{data}) + \left(\frac{C_2}{C_2 + C_1 + C_{p2}}\right)\left(\frac{C_1}{C_1 + C_{p1}}\right)V_{em} = (1-\beta)V_{data} + \gamma\delta \quad \text{[Equation 4]}$$

wherein, $C_{p1}$ is the parasitic capacitance generated by the first node $n_1$ and the adjacent lines, and $\delta$ is a value determined by $C_1/(C_1+C_{p1})$.

On the other hand, the electric potential difference $V_{gs2}$ of the gate electrode g and the second electrode s of the driving transistor $T_{dr}$, corresponds to the difference between the voltage $V_{n2}$ of the second node $n_2$ and the voltage $V_{n1}$ of the first node $n_1$, thus, is determined by [Equation 5] below.

$$V_{gs} = V_{n2} - V_{n1} \quad \text{[Equation 5]}$$
$$= ((1-\alpha)(V_{data} + V_{th}) + \gamma) - ((1-\beta)V_{data} + \gamma\delta)$$
$$= (\beta - \alpha)V_{data} + (1-\alpha)V_{th} - \gamma(1-\delta)$$

Accordingly, in the second coupling period $T_{c2}$, the electric potential difference $V_{gs2}$ between the gate electrode g and the second electrode s of the driving transistor $T_{dr}$ is changed due to the coupling effect of the first capacitor $C_1$ and the second capacitor $C_2$ which are interconnected to each other and the second node $n_2$ is interposed therebetween. That is, the electric potential difference between the gate electrode g and the second electrode s of the driving transistor $T_{dr}$ is the same as the threshold voltage $V_{th}$ of the driving transistor $T_{dr}$ from after the sampling period $T_s$ to before the first coupling period $T_{c1}$, then the voltage of the first node $n_1$ and the voltage of the second node $n_2$ are coupled with the first capacitor $C_1$ and the second capacitor $C_2$ in the first coupling period $T_{c1}$ and the second coupling period $T_{c2}$, and then the voltage of the second node $n_2$ and the voltage of the first node $n_1$ is changed in connection with the emission control voltage $V_{em}$. Accordingly, the electric potential difference $V_{gs}$ between the gate electrode g and the second electrode s of the driving transistor $T_{dr}$ is identically changed too.

The organic light emitting diode (OLED) emits based on the driving current $I_{OLED}$ when the electric potential difference between the anode and the cathode of the organic light emitting diode (OLED) is sufficiently secured. In such case, the first node $n_1$ and the second node $n_2$ are no longer electrically floated, and the electric potential difference $V_{gs2}$ of the gate electrode g and the second electrode s of the driving transistor $T_{dr}$ is constantly maintained. In such case, the driving current $I_{OLED}$ flows to the organic light emitting diode (OLED) is determined by [Equation 6] below.

$$I_{OLED} = \frac{K}{2}(V_{gs} - V_{th})^2 \quad \text{[Equation 6]}$$
$$= \frac{K}{2}[(\beta - \alpha)V_{data} + (1-\alpha)V_{th} - \gamma(1-\delta) - V_{th}]^2$$
$$= \frac{K}{2}[(\beta - \alpha)V_{data} - \alpha V_{th} - \gamma(1-\delta)]^2$$

wherein K is a constant value determined by the characteristics of the driving transistor itself. For example, said value is determined by the mobility of carrier, permittivity of a gate insulation layer, a ratio of the channel width and the channel length, and extra with respect to the driving transistor $T_{dr}$.

It is shown with reference to [Equation 6] that the driving current $I_{OLED}$ has an amount of current in proportional to the data voltage $V_{data}$ squared. The organic light emitting diode (OLED) emits with a brightness corresponding to the driving current $I_{OLED}$, and the driving current $I_{OLED}$ can be adjusted by controlling the data voltage $V_{data}$. Accordingly, the brightness of the organic light emitting diode (OLED) can be controlled by the data voltage $V_{data}$ and the organic light emitting diode (OLED) emits such that the gray level corresponds to the data voltage Vdata.

On the other hand, if the size of the first transistor $T_1$ is very small that the capacitance $C_{gs}$ by the gate electrode and the second electrode of the first transistor $T_1$ is sufficiently small, regarding $\alpha = C_{gs}V_{scan}/(C_2+C_1+C_{gs})$, $C_{gs}$ is being close to zero, thus $\alpha$ is being close to zero. Accordingly, in said [Equation 6], $-\alpha V_{th}$ is being close to zero, and the amount of the driving current $I_{OLED}$ can be substantially constantly maintained regardless of the deviation of the threshold voltage of the driving transistor $T_{dr}$. Accordingly, the sub-pixel according to an exemplary embodiment of the present disclosure compensates the deviation of the threshold voltage $V_{th}$ of the driving transistor $T_{dr}$.

The sub-pixel according to an exemplary embodiment of the present disclosure has a simple circuit layout, thereby providing various advantages. To be specific, the sub-pixel according to an exemplary embodiment of the present disclosure performs a programming operation for applying the data voltage $V_{data}$ to the first node $n_1$ and an initialization operation for initializing the first node $n_1$ by the second transistor $T_2$, and performs an initialization operation for initializing the first electrode d and the gate electrode g of the driving transistor $T_{dr}$ by the first transistor $T_1$ and the third transistor $T_3$. Accordingly, an additional initialization transistor and the signal lines thereof can be omitted. Therefore, the sub-pixel is capable of having a simplified pixel layout. As the layout of the sub-pixel is being simplified, the size of the sub-pixel can be decreased and the number of sub-pixel that can be arranged within a unit area can be increased. Accordingly, the resolution of the display device can be increased and the manufacturing cost can be reduced.

Furthermore, the sub-pixel according to an exemplary embodiment of the present disclosure can stably operate the driving transistor $T_{dr}$ by using the first capacitor $C_1$ and the second capacitor $C_2$ which are connected to the second node $n_2$, in which interposed therebetween, and the side effect caused by the deviation of threshold voltage $V_{th}$ can be minimized. To be specific, it is shown with reference to [Equation 6], the driving current $I_{OLED}$ is dependent on the $(-\alpha V_{th})^2$, however, the effect of the parasitic capacitance $C_{gs}$ generated between the gate electrode and the second electrode of the first transistor $T_1$ may be substantially minimal, thus, $-\alpha V_{th}$ in [Equation 6] is being close to zero. Accordingly, the amount of the driving current $I_{OLED}$ of the driving transistor $T_{dr}$ can be constantly maintain even if a deviation is occurred to the threshold voltage $V_{th}$, and the threshold voltage $V_{th}$ of the driving transistor $T_{dr}$ can be compensated.

On the other hand, the sub-pixel according to an exemplary embodiment of the present disclosure can reduce the coupling phenomenon of the second node $n_2$ and the first node $n_1$ caused by the parasitic capacitance, as some signal lines may be omitted. In case of the related art sub-pixel, the voltage of the gate electrode g of the driving transistor $T_{dr}$ can be drifted due to the additional compensation circuitry and the additional signal lines for controlling thereof. That is, in case when the parasitic capacitance is generated between the gate electrode g of the driving transistor $T_{dr}$ and the signal lines adjacent to the gate electrode g of the driving transistor $T_{dr}$, the voltage of the gate electrode g of the driving transistor $T_{dr}$ is drifted in connection with the signals of the signal lines due to the coupling phenomenon by the parasitic capacitance. However, the sub-pixel according to an exemplary embodiment of the present disclosure has a simple pixel layout, accordingly, the parasitic capacitance may be minimized, and the undesired coupling phenomenon at the first node $n_1$ and the second node $n_2$ may be minimized. Consequently, the voltages of the first node $n_1$ and the second node $n_2$ can be stably maintained, and the driving current $I_{OLED}$ can be stably supplied.

As a result, the sub-pixel according to an exemplary embodiment of the present disclosure has a simplified pixel layout. Thus, the number of sub-pixel that can be arranged within a unit area can be increased. Accordingly, the resolution of the organic light emitting display device can be increased. Furthermore, as the number of signal lines adjacent to each electrode of the driving transistor $T_{dr}$ is decreased, the coupling phenomenon caused by each electrode of the driving transistor $T_{dr}$ and the signal lines can be decreased, and the driving transistor $T_{dr}$ can stably operate. Accordingly, the driving current $I_{OLED}$ can be constantly supplied, and the organic light emitting diode (OLED) can emit with a constant brightness. Moreover, as the number of signal lines is decreased, the parasitic capacitance at the first node $n_1$ and the second node $n_2$ can be decreased. Accordingly, the electric potential difference $V_{gs}$ between the gate electrode g and the second electrode s of the driving transistor $T_{dr}$ may not be affected by the threshold voltage $V_{th}$ of the driving transistor $T_{dr}$. Thus, the effect with respect to the deviation of the threshold voltage $V_{th}$ can be reduced that much.

The exemplary embodiments of the present disclosure can be also described as follows:

According to an aspect of the present disclosure, a sub-pixel may include an organic light emitting diode, a driving transistor, a first capacitor, a second capacitor, a first transistor and a second transistor. The organic light emitting diode may include an anode connected to a first node. The driving transistor may include a first electrode of the driving transistor, a second electrode of the driving transistor may be connected to the first node, and a gate electrode of the driving transistor may be connected to a second node. The first capacitor may be connected between the first node and the second node. The second capacitor may be connected between an emission control line and the second node. The first transistor may include a first electrode of the first transistor connected to the first electrode of the driving transistor, a second electrode of the first transistor connected to the second node, and a gate electrode of the first transistor connected to a scan line. The second transistor may include a first electrode of the second transistor connected to a high potential voltage line, a second electrode of the second transistor connected to the first electrode of the driving transistor, and a gate electrode of the second transistor connected to the emission control line. The first capacitor and the second capacitor may be configured to couple a voltage at the first node and a voltage at the second node based on an emission control voltage supplied to the emission control line. The sub-pixel of the organic light emitting display device according to an exemplary embodiment of the present disclosure may have the first capacitor and the second capacitor, configured to couple a voltage at the first node and a voltage at the second node based on an emission control voltage supplied to the emission control line. Therefore, the circuit layout may be simplified and the threshold voltage of the driving transistor may be compensated. Thus, the uniformity of the brightness of the organic light emitting diode may be maintained regardless of a deviation of the threshold voltage of the driving transistor, and by reducing the size of the sub-pixel, the resolution of the organic light emitting display device may be increased.

The sub-pixel may further include a third transistor comprising a first electrode of the third transistor connected to a data line, a second electrode of the third transistor connected to the first node, and a gate electrode of the third transistor connected to the scan line.

According to an aspect of the present disclosure, an organic light emitting display may include a sub-pixel, a data driver, a scan driver and an emission control driver. The data driver may be configured to supply a data voltage to the sub-pixel. The scan driver may be configured to supply a scan voltage to the sub-pixel. The emission control driver may be configured to supply an emission control voltage to the sub-pixel. The sub-pixel may include an organic light emitting diode, a driving transistor, a first capacitor, and a second capacitor. The organic light emitting diode may include an anode connected to a first node. The driving transistor may include a first electrode of the driving transistor, a second electrode of the driving transistor connected to the first node, and a gate electrode of the driving transistor connected to a second node, which is configured to supply a driving current to the organic light emitting diode. The first capacitor may be connected between the first node and the second node, which is configured to maintain an electric potential difference between the gate electrode of the driving transistor and the second electrode of the driving transistor during an emission period of the organic light emitting diode. The second capacitor may be connected between the second node and an emission control line. The emission control driver may be configured to supply the emission control voltage to the emission control line to couple a voltage at the first node and a voltage at the second node by the first capacitor and the second capacitor during a coupling period within the emission period.

The sub-pixel may further include a first transistor, turned-on based on the scan voltage, configured to electrically float the second node before the coupling period, wherein the first transistor configures a diode connection between the first electrode of the driving transistor and the gate electrode of the driving transistor.

The sub-pixel may further include a second transistor turned-on based on the emission control voltage, and configured to transfer a high potential voltage to the driving transistor during the emission period, wherein the emission control driver may be configured to supply the emission control voltage to turn-on the second transistor during the emission period.

The sub-pixel further may include a third transistor turned-on based on the scan voltage, and configured to transfer the data voltage to the first node, wherein the data driver may be configured to supply an initialization voltage to the third transistor for initializing the first node during an initialization period, and supply the data voltage to the third transistor for charging the first node during at least a portion of period between an end of the initialization period and a beginning of the emission period.

The emission control driver may be configured to supply the emission control voltage to the emission control line to turn-on the second transistor during the initialization period, wherein the scan driver is configured to supply the scan voltage to the scan line to turn-on the first transistor during the initialization period, and wherein the first transistor and the second transistor may be configured to transfer the high potential voltage to the second node to initialize the gate electrode of the driving transistor during the initialization period.

The second transistor may be turned-off at a sampling period after the initialization period, wherein the scan driver may be configured to turn-on the first transistor and the third transistor to sample a threshold voltage of the driving transistor during the sampling period.

The third transistor may be configured to electrically float the first node before the coupling period, wherein the voltage at the first node and the voltage at the second node may be configured to be changed with respect to the emission control voltage during the coupling period.

The data driver may be configured to supply the data voltage corresponding to a certain gray level to the first node through the third transistor, wherein the organic light emitting diode may be emitted with respect to the certain gray level based on an amount of the driving current, which is proportional to a difference value, in which a changed voltage at the second node and a changed voltage at the first node, squared.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purpose only but not intended to limit the technical concept of the present disclosure. The scope of the technical concept of the present disclosure is not limited thereto. The protective scope of the present disclosure should be construed based on the following claims and all the technical concepts in the equivalent scope thereof should be construed as falling within the scope of the present disclosure.

What is claimed is:

1. A sub-pixel of an organic light emitting display device, the sub-pixel comprising:

an organic light emitting diode comprising an anode connected to a first node;

a driving transistor comprising a first electrode of the driving transistor, a second electrode of the driving transistor connected to the first node, and a gate electrode of the driving transistor connected to a second node;

a first capacitor connected between the first node and the second node;

a second capacitor connected between an emission control line and the second node;

a first transistor comprising a first electrode of the first transistor connected to the first electrode of the driving transistor, a second electrode of the first transistor connected to the second node, and a gate electrode of the first transistor connected to a scan line; and a second transistor comprising a first electrode of the second transistor connected to a high potential voltage line, a second electrode of the second transistor connected to the first electrode of the driving transistor, and a gate electrode of the second transistor connected to the emission control line, wherein the first capacitor and the second capacitor are configured to couple a voltage at the first node and a voltage at the second node based on an emission control voltage supplied to the emission control line.

2. The sub-pixel of the organic light emitting display device of claim 1, further comprising:

a third transistor comprising a first electrode of the third transistor connected to a data line, a second electrode of the third transistor connected to the first node, and a gate electrode of the third transistor connected to the scan line.

3. The sub-pixel of the organic light emitting display device of claim 1, wherein the first transistor and the third transistor are turned-off at a coupling period before an emission period of the organic light emitting diode by the scan voltage of a low level applied to the scan line, such that the first node and the second node are electrically floating.

4. An organic light emitting display device comprising:

a sub-pixel;

a data driver configured to supply a data voltage to the sub-pixel;

a scan driver configured to supply a scan voltage to the sub-pixel; and an emission control driver configured to supply an emission control voltage to the sub-pixel, wherein the sub-pixel comprises:

an organic light emitting diode comprising an anode connected to a first node;

a driving transistor configured to supply a driving current to the organic light emitting diode, the driving transistor comprising a first electrode of the driving transistor, a second electrode of the driving transistor connected to the first node, and a gate electrode of the driving transistor connected to a second node;

a first capacitor connected between the first node and the second node, and configured to maintain an electric potential difference between the gate electrode of the driving transistor and the second electrode of the driving transistor during an emission period of the organic light emitting diode;

a second capacitor connected between the second node and an emission control line; and a first transistor, turned-on based on the scan voltage, and configured to electrically float the second node before the coupling period, wherein the emission control driver is configured to supply the emission control voltage to the emission control line to couple a voltage at the first node and a voltage at the second node by the first capacitor and the second capacitor during a coupling period within the emission period, and wherein the first transistor configures a diode connection between the first electrode of the driving transistor and the gate electrode of the driving transistor.

5. The organic light emitting display device of claim 4, wherein the sub-pixel further comprises:

a second transistor turned-on based on the emission control voltage, and configured to transfer a high potential voltage to the driving transistor during the emission period, wherein the emission control driver is configured to supply the emission control voltage to turn-on the second transistor during the emission period.

6. The organic light emitting display device of claim 5, wherein the sub-pixel further comprises:

a third transistor turned-on based on the scan voltage, and configured to transfer the data voltage to the first node, wherein the data driver is configured to supply an initialization voltage to the third transistor for initializing the first node during an initialization period, and supply the data voltage to the third transistor for charging the first node during at least a portion of period between an end of the initialization period and a beginning of the emission period.

7. The organic light emitting display device of claim 6, wherein the emission control driver is configured to supply the emission control voltage to the emission control line to turn-on the second transistor during the initialization period, wherein the scan driver is configured to supply the scan voltage to the scan line to turn-on the first transistor during the initialization period, and wherein the first transistor and the second transistor are configured to transfer the high potential voltage to the second node to initialize the gate electrode of the driving transistor during the initialization period.

8. The organic light emitting display device of claim 6, wherein the second transistor is turned-off at a sampling period after the initialization period, and wherein the scan driver is configured to turn-on the first transistor and the third transistor to sample a threshold voltage of the driving transistor during the sampling period.

9. The organic light emitting display device of claim 6, wherein the third transistor is configured to electrically float the first node before the coupling period, and wherein the voltage at the first node and the voltage at the second node are configured to be changed with respect to the emission control voltage during the coupling period.

10. The organic light emitting display device of claim 9, wherein the data driver is configured to supply the data voltage corresponding to a certain gray level to the first node through the third transistor, and wherein the organic light emitting diode is emitted with respect to the certain gray level based on an amount of the driving current, which is proportional to a difference value, in which a changed voltage at the second node and a changed voltage at the first node, squared.

11. The organic light emitting display device of claim 6, wherein the gate electrode of the first transistor is connected to a scan line, the first transistor and the third transistor are turned-off at another coupling period before the coupling period by the scan voltage of a low level applied to the scan line, such that the first node and the second node are electrically floating.

12. The organic light emitting display device of claim 4, wherein the sub-pixel is defined by crossing of a data line and a gate line, the data driver is configured to apply an initialization voltage to the data line during an initialization period, and apply the data voltage to the data line during at least portion of a programming period after the initialization period, such that the initialization voltage and the data voltage are complexly applied to the data line according to the driving timing.

* * * * *